US005149498A

United States Patent [19]

Nilmen et al.

[11] Patent Number: 5,149,498

[45] Date of Patent: Sep. 22, 1992

[54] METHOD OF PRODUCING TARNISH-RESISTANT AND OXIDATION-RESISTANT ALLOYS USING ZR AND B

[75] Inventors: Fehmi Nilmen, Kriftel; Heinrich Winter, Eschborn, both of Fed. Rep. of Germany

[73] Assignee: Battelle-Institut e.V., Frankfurt am Main, Fed. Rep. of Germany

[21] Appl. No.: 449,906

[22] PCT Filed: Apr. 14, 1989

[86] PCT No.: PCT/EP89/00404

§ 371 Date: Dec. 18, 1989

§ 102(e) Date: Dec. 18, 1989

[87] PCT Pub. No.: WO89/09838

PCT Pub. Date: Oct. 19, 1989

[30] Foreign Application Priority Data

Apr. 16, 1988 [DE] Fed. Rep. of Germany ..... 3812738

[51] Int. Cl.[5] ..... C22C 1/02; C22C 9/00; C22C 5/06

[52] U.S. Cl. ..... 420/492; 420/501; 164/55.1; 164/56.1; 164/57.1

[58] Field of Search ..... 420/492, 501; 164/55.1, 164/56.1, 57.1

[56] References Cited

U.S. PATENT DOCUMENTS

| | | | |
|---|---|---|---|
| 3,194,656 | 7/1965 | Vordahl | 75/135 |
| 3,993,478 | 11/1976 | Hay et al. | 75/159 |
| 4,073,667 | 7/1978 | Caron | 148/12.7 |
| 4,284,436 | 8/1981 | Stefan et al. | 420/484 |
| 4,419,130 | 12/1983 | Slaughter | 75/244 |
| 4,451,430 | 5/1984 | Matidori et al. | 420/492 |
| 4,540,546 | 9/1985 | Giessen | 420/590 |
| 4,744,947 | 5/1988 | Nilmen et al. | 420/590 |

FOREIGN PATENT DOCUMENTS

| | | |
|---|---|---|
| 3522341 | 3/1987 | Fed. Rep. of Germany . |
| 359286 | 10/1973 | U.S.S.R. . |

OTHER PUBLICATIONS

J. Rexer and G. Petzow, Metall., 24, (1970), pp. 1083–1086, "Über den Aufbau und einige Eigenschaften von Kupfer-Bor-Legierungen".

F. Lihl and O. Feischl, Metall., 8, (1954), pp. 11 and 12 "Herstellung und Konstitution von Kupfer-Bor-Legierungen".

A. J. Perry et al., Journal of Materials Science, 8, (1973), pp. 1340–1348, "The Copper-Boron Eutectic-Unidirectionally Solidified".

Dies, K., "Kupfer and Kupferlegierungen in der Technik", (1967), pp. 134 and 405.

Chemical Abstracts, vol. 76, No. 8, (1972), 36789x.

Snow et al., "Rapid Solidification Processing of Superalloys Using High Powered Laser", Rapid Solidification Source Book, (1983), pp. 138–152.

Razavi-Zadeh et al., "Deoxidizing Copper with $CaB_6$", Journal of Metals, vol. 39, No. 2, (Feb. 1987), Metallurgical Society, pp. 42 to 47.

*Primary Examiner*—R. Dean
*Assistant Examiner*—Margery S. Phipps
*Attorney, Agent, or Firm*—Fisher, Christen & Sabol

[57] ABSTRACT

Method for producing tarnish-resistant and oxidation-resistant sheets, billets, rods, tubes, profiles or wires for tarnish-resistant and oxidation-resistant structural components which tolerate thermal and mechanical stresses, of copper or silver as matrix material exhibiting a high conductivity and a high softening temperature. The method includes preparing a copper or silver melt by adding, to the copper or silver, stoichiometric amounts of boron and zirconium whereby the stoichiometric amounts comprise additions of 0.3 to 0.6 weight percent of zirconium and 0.1 to 0.2 weight percent of boron, resulting in a fine dispersion melt of less than 1 volume percent of $ZrB_2$ in the copper or silver. Subsequently, the fine dispersion melt is processed into semifinished products using continuous casting units or continuous rolling units. The semifinished products and the said structural components made therefrom exhibit a combination of a high electrical conductivity from over 95 up to 99 percent IACS, a high softening temperature of at least 600° C., high tensile strength at 800° C. (in the range of 120 $N/mm^2$), an excellent formability and a resistance to atmospheres containing pollutants, such as, $H_2S$ and NaCl. Excess calcium hexaboride, $CaB_6$ can be used as a deoxidant, such that the excess serves for introducing the necessary boron proportion into the copper or silver melt. Silver alloys are produced which are tarnish-resistant in a sulfur-containing environment.

5 Claims, No Drawings

METHOD OF PRODUCING TARNISH-RESISTANT AND OXIDATION-RESISTANT ALLOYS USING ZR AND B

BACKGROUND OF THE INVENTION

1. Field of the Invention

The invention relates to a method of producing tarnish- and oxidation-resistant alloys on the basis of copper or silver, small additions of boron and zirconium being added to the melt.

2. Background Art

A method of dispersion hardening of copper, silver or gold as well as of their alloys as matrix material with metal borides as dispersoid, is already known (German Published Patent Application No. 3,522,341); according to this method, the melt on the basis of the matrix metals with stoichiometric additions of boron and boride-forming metals is superheated by 300° to 750° C. to form metal boride in an amount of 1 to 5 volume %, and subsequently subjected to extremely rapid solidification. The necessary superheating of the melt requires high-priced crucible material, and the extremely rapid solidification requires sophisticated powder-metallurgical processes.

BROAD DESCRIPTION OF THE INVENTION

The object of the invention is to provide a method which functions without high superheating of the melt, and which does not make demands concerning rapid solidification, but operates with low alloying additions. This object is achieved by the process of the invention. The invention involves a method of producing tarnish-resistant and oxidation-resistant alloys on the basis of copper or silver with a high electrical conductivity of more than 90 percent IACS and a softening temperature of more than 550° C. Stoichiometric amounts of boron and zirconium are added to the copper or silver melt. A copper or silver melt containing additions of preferably 0.3 to 0.6 weight percent of zirconium and 0.1 to 0.2 weight percent of boron to form a fine dispersion of less than 1, preferably 0.4 to 0.8 volume percent, such that the melt can be processed into seminfinished products using continuous casting and rolling units. The method according to the invention leads to a very high resistance to tarnishing and oxidation. As this method requires only very low alloying additions, which combine to give the insoluble boride, the electrical conductivity corresponds practically to that of pure copper. This also results in excellent formability of the material produced according to this method. This method can be used to produce tarnish- and oxidation-resistant sheets and profiles, for example tubes, rods or wires, which have electrical conductivities between 97 and 99% IACS of that of pure copper, permitting softening temperatures above 550° C. The material produced according to this method is suitable in particular for thermally stressed electrical conductors, contacts, connectors, as well as for semiconductor carriers. In addition, the principle of the invention can be transferred to silver. If, for example, the silver melt or the silver-alloy melt contains additions of zirconium and boron in order to form zirconium boride in an amount of less than 1 volume %, preferably 0.4 to 0.8 volume %, this, too, will essentially improve the resistance of silver to tarnishing.

Another advantageous development of the invention results, when in the invention method, excess calcium hexaboride $CaB_6$ is used as deoxidant, such that the excess serves for introducing the necessary boron proportion into the copper or silver melt. A further advantageous development of the invention results, when in the invention method, sheets, profiles and wires for tarnish-resistant and oxidation-resistant structural components tolerating thermal and mechanical stresses are produced for application in pollutant-containing atmospheres. A further advantageous development of the invention results, when in the invention method, semiconductor carriers, electrical contacts, connectors and wire for highly stressed engines and generators are produced. Another advantageous development of the invention results, when in the invention method, silver alloys are produced which are tarnish-resistant in a sulfur-containing environment.

DETAILED DESCRIPTION OF THE INVENTION

The materials produced according to this method are suited in particular for highly stressed electric motors and generators.

In an advantageous manner, the melt contains 0.3 to 0.6 weight % zirconium and 0.1 to 0.2 weight % boron.

According to a development of the invention, it is advantageous to deoxidize the melt prior to the addition of zirconium and boron. This ensures that the desired volume percentage of zirconium boride can be formed. It is advantageous to use calcium hexaboride $CaB_6$ as deoxidant.

According to a further development of the invention, it is advantageous to add zirconium and boron in the form of master alloys or powder compacts of copper with zirconium or boron or calcium hexaboride $CaB_6$ to the deoxidized melt. This results in loss-free incorporation of the alloying elements in the melt. It is advantageous to effect melting in an inert gas atmosphere in order to prevent oxidation of the melt.

According to a further development of the invention, it is advantageous to process the melt, after addition of zirconium and boron, in a continuous casting and rolling unit, into sheets or billets for further processing into wire or profiles. This is possible because the low-alloy melts solidify in the casting and rolling unit at a sufficiently high rate.

The material produced according to this method can be processed into sheets or profiles or wire and is not damaged by exposure to an atmosphere which contains pollutants such as $H_2S$ or NaCl. The materials produced according to this method are also suited for sheets and profiles for architectonic purposes, for example for facades or roofs.

Further advantageous developments of the invention result from the subclaims.

The method according to the invention serves for producing a tarnish- and oxidation-resistant material on the basis of copper and its alloys. Low proportions of additions of boron or zirconium in the copper melt or in the copper-alloy melt are sufficient to form zirconium boride in an amount of less than 1 volume %, preferably 0.4 to 0.8 volume %. These low additions result in a tarnish- and oxidation-resistant material. Furthermore, this method does not necessitate exposure of the melt to strong superheating and subsequently to a high solidification rate. The low-alloy melts, therefore, can advantageously be processed in continuous casting and rolling units into sheets, extrusion billets or primary material for wire drawing. The semifinished products such as sheets, rods, tubes, wire, which are produced in this very economical manner saving alloying additions, are characterized by the above-mentioned tarnishing and oxidation resistance. Strengthening by cold working is not affected up to temperatures of 500° C. and above. In addition, measurements showed that the electrical conductivity practically comes up to the conductivity of copper (the IACS values amount to about 99 %). The same applies to thermal conductivity. The alloys produced by the method according to the invention thus offer an excellent combination of tarnishing and oxidation resistance with high softening temperature as well as electrical and thermal conductivity and good formability. The production cost of the material can be substantially reduced, as on the one hand less alloying additions are required and on the other hand continuous casting and rolling units are used which involve low cost. These materials therefore are excellently suited to produce thermally and mechanically highly stressed electrical conductors as well as electrical contacts, connectors, semiconductor carriers, and they can safely be used in pollutant-containing atmosphere, e.g. in air containing $H_2S$ or NaCl.

In addition, these materials can be used for facades and roofs as well as in the construction of chemical apparatus.

In a 100-hour oxidation test with about 1,200 temperature changes between 20° and 300° C., the fairly good alloy of copper with 0.8 weight % chromium showed a weight increase of 4 mg/cm$^2$, whereas the alloy of copper with combined proportions of 0.4 weight % zirconium and 0.1 weight % boron, produced according to the invention, in the same test reached a weight increase as low as 0.5 mg/cm$^2$. The tensile strength of the rolled alloy at room temperature was 450 N/mm$^2$ at an elongation of 12%. The softening temperature was found to be >600° C., whereas the strength at 800° C. still amounted to 120 N/mm$^2$. The elongation in the tensile test between room temperature and 800° C. increased continuously from 12 to 19%. The electrical conductivity of the rolled and tempered specimen at room temperature was found to be 97.5% IACS. To obtain further improved results, it is particularly advantageous if the copper melt is thoroughly deoxidized and if the alloying additions are introduced in an inert gas atmosphere or in vacuum. Particularly favorable results can be obtained after a deoxidation treatment of the melt with calcium hexaboride ($CaB_6$). Calcium hexaboride was added in the form of pellets pressed from five parts of copper powder and one part of $CaB_6$ powder after thorough mixing.

It was found advantageous to perform deoxidation and boron addition in one step, and subsequently to add the zirconium in the form of a copper-zirconium master alloy from pressed powders.

If the method according to the invention is applied analogically, it is possible to produce a material on the basis of silver and its alloys. In this case the melt contains zirconium boride in an amount of less than 1 volume %, preferably 0.4 to 0.8 volume %. This above all makes it possible to use the method for producing a tarnish-resistant material on the basis of silver, which is largely insensitive to hydrogen sulfide $H_2S$.

Thorough investigations showed that a dispersion of very fine zirconium diboride particles is rapidly formed immediately upon introduction of boron and zirconium into a copper or silver melt. These particles are insoluble in the melt and, after solidification in the matrix, they remain absolutely stable up to the melting temperature. This is the cause of the high thermal stability and softening temperature on the one hand and of the high electrical and thermal conductivity as well as the excellent formability of the alloys according to the invention, on the other. In addition, it was found that the alloys according to the invention, at temperatures above about 500° C. in air, become covered with a thin, continuous layer of a glass-like protective film of $Cu_3B_2O_6$ or of $Ag_3B_2O_6$, which largely prevents indiffusion of oxygen and other pollutants such as sulfur. As the principle is hardly dependent on impurities and small additions, even low-alloy alloys on the basis of copper or silver can be greatly improved with respect to their tarnishing and oxidation resistance and to their softening temperature.

We claim:

1. Method for producing a tarnish-resistant and oxidation-resistant sheets, billets, rods, tubes, profiles or wires for tarnish-resistant and oxidation-resistant structural components which tolerate thermal and mechanical stresses, of copper or silver as a matrix material exhibiting a high conductivity and a high softening temperature, comprising:

preparing a copper or silver melt by adding, to said copper or silver, stoichiometric amounts of boron and zirconium whereby said stoichiometric amounts comprise additions of 0.3 to 0.6 weight percent of zirconium and 0.1 to 0.2 weight percent of boron, resulting in a fine dispersion melt of less than 1 volume percent of $ZrB_2$ in said copper or silver; and subsequently processing the fine dispersion melt into a semifinished product using continuous casting units or continuous rolling units, wherein said semifinished product and said structural component made therefrom exhibit a combination of a high electrical conductivity from over 95 up to 99 percent IACS, a high softening temperature of at least 600° C., high tensile strength of 800° C. (in the range of 120 N/mm$^2$), an excellent formability and a resistance to corrosive environments.

2. Method as claimed in claim 1 wherein a deoxidation and the boron addition are performed in one step by using an excess of calcium hexaboride $CaB_6$ to supply said stoichiometric amount of boron for the formation of the fine $Zrb_2$-dispersion in the copper or silver melt before adding the zirconium in the form of a copper-zirconium master alloy.

3. Method as claimed in claim 1 wherein a silver alloy is produced which is tarnish-resistant in a sulfur-containing environment.

4. Method as claimed in claim 1 wherein the fine dispersion melt has 0.4 to 0.8 volume percent of $ZrB_2$.

5. Method as claimed in claim 1 wherein the semifinished product is in the form of tarnish-resistant and oxidation-resistant sheets, billets, tubes, rods or profiles.

* * * * *